United States Patent [19]

Kyono et al.

[11] Patent Number: 4,629,659

[45] Date of Patent: Dec. 16, 1986

[54] CORROSION RESISTANT SURFACE-TREATED STEEL STRIP AND PROCESS FOR MAKING

[75] Inventors: Kazuaki Kyono; Shigeo Kurokawa; Hajime Kimura; Toshio Irie, all of Chiba, Japan

[73] Assignee: Kawasaki Steel Corporation, Kobe, Japan

[21] Appl. No.: 609,751

[22] Filed: May 14, 1984

[30] Foreign Application Priority Data

May 14, 1983 [JP] Japan ..... 58-84585
Feb. 23, 1984 [JP] Japan ..... 59-33304
Feb. 23, 1984 [JP] Japan ..... 59-33305

[51] Int. Cl.[4] ..... B32B 15/00

[52] U.S. Cl. ..... 428/659; 204/44.2; 204/44.7; 428/681

[58] Field of Search ..... 428/681, 682, 683, 684, 428/685, 621, 659; 204/44.2, 44.7

[56] References Cited

U.S. PATENT DOCUMENTS 2,412,543 12/1946 Tanner ..... 428/659
2,994,126 8/1961 Kennedy ..... 428/659
3,086,927 4/1963 Chessin et al. ..... 204/44.7
3,574,566 4/1971 Dwors ..... 428/659
3,713,902 1/1973 Vrijburg et al. ..... 428/659

FOREIGN PATENT DOCUMENTS 45-15851 6/1970 Japan ..... 428/659
0030728 3/1977 Japan ..... 428/659
56-142885 11/1981 Japan .
57-67195 4/1982 Japan .
57-198293 12/1982 Japan .
58-34192 2/1983 Japan .
58-52483 3/1983 Japan .
1519125 7/1978 United Kingdom .
264098 6/1970 U.S.S.R. ..... 204/44.7

OTHER PUBLICATIONS

*Metals Handbook Ninth Edition,* vol. 5, "Surface Cleaning, Finishing, and Coating", American Society for Metals, 1982. p. 323.

*Primary Examiner*—L. Dewayne Rutledge
*Assistant Examiner*—Robert L. McDowell
*Attorney, Agent, or Firm*—Young & Thompson

[57] ABSTRACT

Highly corrosion resistant plated steel strips or sheets adapted for phosphate treatment and cathodic electrodeposition and intended for use in automobiles, are produced by electroplating at least one surface of a steel strip with an alloy consisting essentially of 0.0003 to 15% by weight of phosphorous, balance essentially iron, in a plating bath containing $Fe^{2+}$ ions in an amount of from 0.3 mol/liter to the solubility limit and hypophosphorous acid and/or a hypophosphite in an amount of 0.001 to 25 g/liter expressed as $NaH_2PO_2 \cdot H_2O$ at a pH of 1.0 to 5.0, a temperature of 30° to 60° C., and a current density of from more than 20 to 200 A/dm$^2$, preferably 40 to 150 A/dm$^2$. A top coat can be applied thereover, of one element selected from the group consisting of Ni, Zn, Mn, and Ti, deposited on the Fe-P plating layer to a build-up of 5 to 50 mg/m$^2$. A lower layer of zinc or a zinc alloy can also be electrodeposited on at least one surface of the steel strip, prior to formation of the Fe-P layer. A surface film can be formed by chemically treating the Fe-P plating layer with a phosphate.

11 Claims, 5 Drawing Figures

CORROSION RESISTANT SURFACE-TREATED STEEL STRIP AND PROCESS FOR MAKING

This invention relates to highly corrosion resistant plated steel strips or sheets adapted for phosphate treatment and cathodic electrodeposition and intended for use in automobiles; and chemically treated steel strips prepared by subjecting the plated steel strips to an ordinary phosphate treatment as generally employed for cold rolled steel and zinc or zinc alloy plated steel to thereby form a surface film having improved corrosion resistance without paint coating; as well as a process for making such plated and treated steel strips.

BACKGROUND OF THE INVENTION

For steel strips intended for use in automobiles, electrophoretic deposition or painting is often used to form a primer coating. Cationic paint particles are electrodeposited on the surface of a workpiece to be coated during deposition, creating defects in the coating. At the same time, $H_2$ gas is concomitantly generated due to electrolysis of the medium, that is, water so that hydrogen gas bubbles break the previously electrodeposited coating, also creating defects in the coating. The occurrence of such coating defects generally called craters is a phenomenon inherent to steel strips plated with zinc or its alloy.

Zinc or zinc alloy plated steel strips further exhibit inferior secondary wet adhesion of coating after they are triply coated with a cathodic electrophoretic painting, a sealer coating, and a top coating. By the (secondary) wet adhesion of (paint) coating is meant the adhesion to the treated steel of a paint coating which has been deteriorated through any appropriate process under moist environment. One test method is to dip a triple coated steel strip in water at 40° C. for 10 days and to conduct a scribed adhesion test on the strip immediately after its removal from the water.

In order to improve the wet adhesion of paint coating and to prevent crater formation, an Fe plating treatment was proposed as disclosed in Japanese Patent Application Kokai Nos. 57-67195, 57-198293, and 58-34192. The treatment by pure Fe plating is, however, incompatible with bonderizing or phosphate treatment to be followed. A relatively small number of nuclei of phosphate generate on a pure Fe plating, resulting in a phosphate film of relatively rough or large phosphate crystals. Some phosphate treating solutions result in a lack of coating and are unsuccessful in improving the wet adhesion of paint coating. No beneficial effect is achieved particularly by the phosphate treatment of spray type.

The basic consideration about rust preventive steel must involve not only the rust preventive abilities that an electroplating on steel strips and a paint coating thereon individually possess, but also the overall rust prevention resulting from the synergistic effect of both the electroplating and the paint coating. More particularly, zinc or zinc alloy plated steel strips, which have improved corrosion prevention because of the sacrificial protection of the underlying steel by the plating and the protection by corrosion products, have found a wide variety of applications in automobiles, electric appliances, building materials and the like. On the other hand, cathodic electrophoretic deposition or painting has been spread which provides appreciably high corrosion resistance. However, applying the cathodic electrophoretic deposition to zinc or zinc alloy electroplated steel does not achieve such a remarkable effect as encountered when the cathodic electrophoretic deposition is directly applied to cold rolled steel strips.

Although the zinc or zinc alloy plating and the cathodic electrophoretic deposition provide excellent corrosion prevention when applied alone, their combination does not lead to satisfactory rust preventive ability because a phosphate film is formed on the plating of zinc or zinc alloy. This film consists essentially of hopeite, $Zn_3(PO_4)_2.4H_2O$, which is not resistant to alkali and is dissolved due to an increase in pH during cathodic electrophoretic deposition or caused by corrosion under paint coatings. This results in the poor adhesion and reduced blister resistance of paint coating under moist environment. Contrary, a phosphate film consisting essentially of phosphophyllite, $Zn_2Fe(PO_4)_2.4H_2O$ is formed on cold rolled steel strips. Phosphophyllite is resistant to alkali and thus substantially improves the adhesion and blister resistance of paint coatings under moist environment. It is thus believed that the wet adhesion of paint coating can be improved by forming a phosphate film of phosphophyllite on zinc or zinc alloy plated steel strips.

Among methods for rendering steel strips more adaptable to chemical conversion or phosphate treatment are known an Fe plating treatment as disclosed in Japanese Patent Application Kokai Nos. 56-142885 and 57-67195, and a relatively iron rich Fe-Zn plating treatment as disclosed in Japanese Patent Application Kokai No. 58-52483. Such prior art Fe plating treatments yield a relatively stable plating surface and thus, some treating solutions fail to fully improve phosphatability. The iron rich Fe-Zn plating treatment is effective in forming phosphophyllite only in the limited optimum range of plating conditions and often results in a nonuniform appearance. Although the formation of phosphophyllite improves the wet adhesion of paint coating and hence, the corrosion resistance after painting, the resulting phosphate film itself has little corrosion resistance and consequently, the phosphated steel strips only exhibit corrosion resistance substantially equal to that of uncoated, untreated steel strips. In general, steel strips are marketed after they are configured to a variety of shapes and painted. Many such configured parts include some sites where paint does not flow or spread well. For this reason the corrosion resistance without paint coating is of substantial importance to steel strips even though they are normally coated with paint.

Apart from the traditional concept that phosphate films are underlying or intervening films on which paint is applied, the inventors have made investigations about surface-treated steel strips from the novel point of view that novel and improved surface treated steel strips are produced by imparting corrosion resistance without paint coating to phosphate films themselves.

SUMMARY OF THE INVENTION

It is, therefore, an object of the present invention to provide an Fe-P/Zn or Zn alloy double layer plated steel strip adapted for subsequent phosphate treatment and cathodic electrophoretic deposition.

Another object of the invention is to provide a surface treated steel strip having improved corrosion resistance without paint coating or just after it is plated with Zn or Zn alloy and then with an Fe-P alloy and formed with a phosphate film.

A further object of the invention is to provide a process for making such surface treated steel strips adapted for subsequent phosphate treatment and cathodic electrophoretic deposition and having a phosphate film exhibiting improved corrosion resistance without paint coating.

According to a first aspect of the present invention, an Fe-P plated steel strip adapted for phosphate treatment comprises a steel strip; a lower layer of Zn or a Zn alloy electrodeposited on at least one surface of the steel strip; and an upper layer of an Fe-P system with a phosphorus content of 0.0003 to 15% by weight electrodeposited on said lower layer to a build-up of at least 0.5 $g/m^2$.

According to a second aspect of the present invention, an Fe-P plated steel strip adapted for phosphate treatment comprises a steel strip; a lower layer of Zn or a Zn alloy electrodeposited on at least one surface of the steel strip; an upper layer of an Fe-P system with a phosphorus content of 0.0003 to 15% by weight electrodeposited on said lower layer to a build-up of at least 0.5 $g/m^2$; and a topcoat of one element selected from the group consisting of Ni, Zn, Mn, and Ti, and deposited on said upper layer to a build-up of 5 to 50 $mg/m^2$.

According to a third aspect of the present invention, a phosphate treated steel strip having improved corrosion resistance without paint coating is provided which comprises a steel strip; a lower layer of zinc or zinc alloy on at least one surface of the steel strip; a layer of an Fe-P system with a phosphorus content of 0.0003 to 15% by weight electrodeposited on the lower layer to a build-up of at least 0.05 $g/m^2$; and a phosphate film formed by chemically treating the Fe-P plating layer with a phosphate.

According to a further aspect of the present invention, there is provided a process for making an Fe-P/Zn or Zn alloy double layer system plated steel strip. At least one surface of a Zn or Zn alloy plated steel strip is electroplated with an Fe-P system alloy containing 0.0003 to 15% by weight of phosphorus in a plating bath containing $Fe^{2+}$ ions in an amount of from 0.3 mol/liter up to the solubility limit and hypophosphorous acid or a hypophosphite in an amount of 0.001 to 25 g/liter as expressed in $NaH_2PO_2.H_2O$ at a pH of 1.0 to 5.0, a temperature of 30° to 60° C. and a current density of from more than 20 to 200 $A/dm^2$.

BRIEF DESCRIPTION OF THE DRAWINGS

The above and other objects, features, and advantages of the present invention will be more fully understood by reading the following description taken in conjunction with the accompanying drawings, in which.

DETAILED DESCRIPTION OF THE INVENTION

The Fe-P plated steel strips of the prevent invention will be described in further detail.

The Fe-P plating to be applied in the practice of the present invention is effective as long as the phosphorus content is in the range of 0.0003 to 15% by weight. First we did not find this overall range to be effective, but have found certain ranges to be effective in the progress of our research.

In the initial stage, we made research from the point of view of formation of phosphate crystal nuclei at an initial stage of phosphate treatment and found that the preferred phosphorus content is in the range of 0.0003 to 0.5% by weight of the Fe-P plating.

Nevertheless, we have continued research from a broader aspace of eventually forming a phosphated film to find that evaluation in terms of initial nucleus formation is somewhat severe to obtain an acceptable phosphated film. We have found that phosphorus contents in the range of 0.5 to 15% by weight is satisfactory.

These different ranges of phosphorus content are defined for different reasons and will be separately discussed below.

The Fe-P plating should be carried out in the practice of the present invention according to any aspects thereof. When the number of phosphate crystal nuclei formed at an initial stage of subsequent phosphate treatment or bonderizing is taken into account, the Fe-P plating layer should contain 0.0003 to 0.5% by weight of phosphorus. A pure Fe plating layer yields a stable oxide film on the surface which retards the initial reaction of the phosphate treatment and causes crystals to grow rough. The presence of phosphorus in such a minor proportion is effective to substantially promote the initial reaction of the phosphate treatment and to increase the initial number of crystal nuclei.

Figure 1:
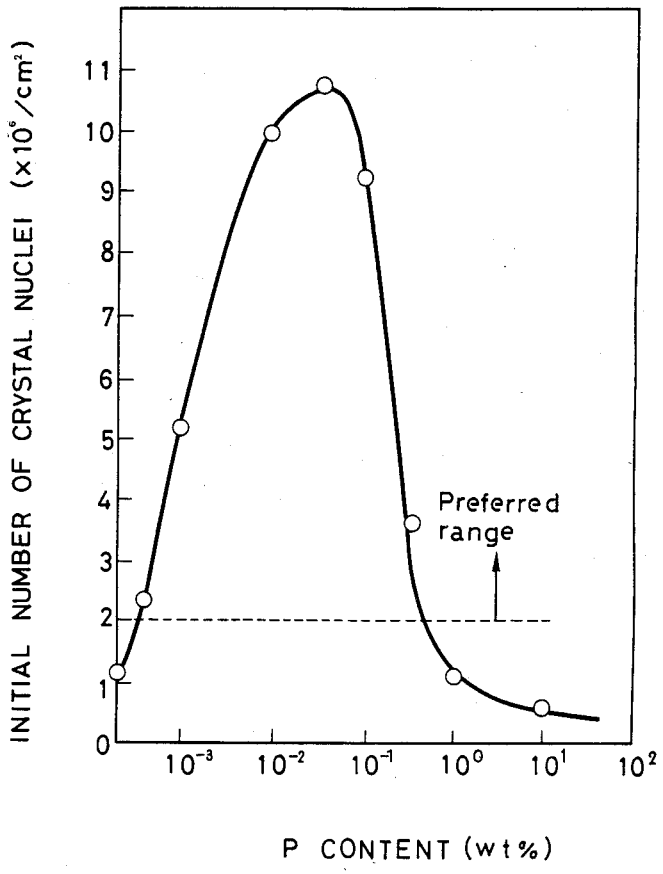
FIG. 1 is a graph in which the P content of Fe-P platings is plotted in relation to the number of crystal nuclei at the initial (after 5 seconds)
Figure 2A:
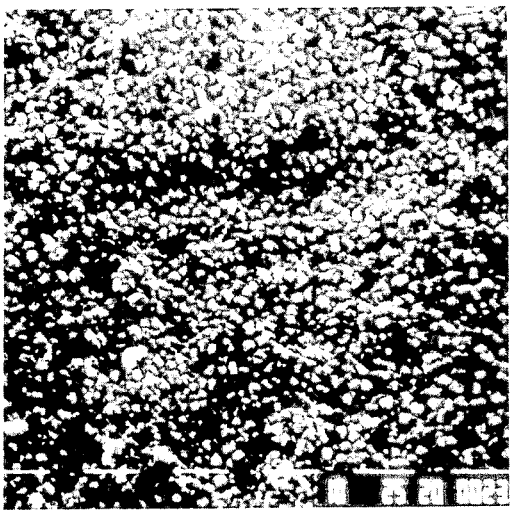
FIGS. 2*a* and 2*b* are scanning electron photomicrographs (750×) of a steel strip treated according to the present invention (a cold rolled steel coated with 2.5 $g/m^2$ of an Fe-P plating with a P content of 1.5% by weight) and a steel strip bonderized in a conventional manner (SPCC, using Granodine SD-2000) after 120 seconds, respectively.
Figure 2B:
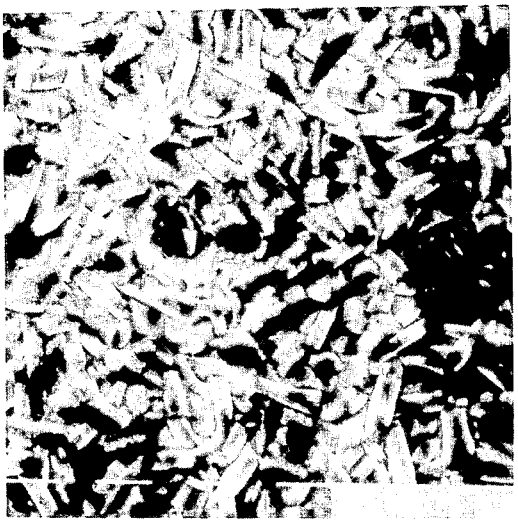

FIG. 1 is a graph showing the initial number of crystal nuclei vs P content. Steel strips were plated with various Fe-P plating layers to a build-up of 2.0 $g/m^2$ and then immersed for 5 seconds in a phosphating solution (Bonderite #3004, manufactured and sold by Nihon Parkerizing K.K.). The number of phosphate crystal nuclei formed at the end of the 5 second immersion was determined. It was found from FIG. 1 that the initial reaction of phosphate treatment is substantially promoted when the phosphorus content in the Fe-P plating ranges from 0.0003% to 0.5% by weight.

When the quality of a final phosphate film resulting from phosphate treatment is evaluated in terms of the P proportion and crystal size which are considered most important by those skilled in the art, the Fe-P plating layer should contain phosphorus in an amount of 0.5% to 15.0% by weight.

As previously mentioned for Fe-P plating layers having a phosphorus content of 0.0003% to 0.5% by weight, the initial number of crystal nuclei after 5 seconds is substantially increased within this higher phosphorus content range.

In the practice of phosphate treatment, even when the initial number of crystal nuclei after 5 seconds of phosphate treatment is small, crystal nuclei continue to generate thereafter. It was found that evaluation in terms of the initial number of crystal nuclei after 5 seconds is too severe to apply to most treated steel strips intended for commercial use.

Phosphatability, that is, adaptability to phosphate treatment is generally evaluated on the basis of the phosphate crystals formed after 120 seconds of phosphate treatment. In general, the surface film resulting from the phosphate treatment is of most importance. Likewise, in the present invention, the quality of the final surface film is evaluated in terms of the phosphorus proportion and crystal size which are at present considered most important by those skilled in the art.

When the phosphorus content of Fe-P plating exceeds 0.5% by weight, a smaller number of crystal nuclei generate after 5 seconds of phosphate treatment, but a further number of crystal nuclei continuously generate thereafter, eventually yielding a film of high quality, that is, a dense nonporous film characterized by a reduced crystal size. The phosphate content range has been broadened because steel strips having such a film are also within the scope of the present invention.

With the increasing content of phosphorus, the efficiency of cathodic Fe-P electroplating declines, which is economically disadvantageous. Fe-P platings having an extremely high phosphorus content are platings of amorphous type which are often less reactive in the phosphate treatment.

For this reason, the upper limit of the phosphorus content is limited to 15% by weight although the preferred phosphorus content is not more than 10% by weight and most preferably not more than 5% by weight.

As is well known in the art, when steel strips plated with zinc or a zinc based alloy are subjected to a phosphate treatment or bonderizing, a film of hopeite $Zn_3(PO_4)_2.4H_2O$ is formed, resulting in the inferior secondary wet adhesion of a coating layer formed by triple coatings including cathodic electrophoretic deposition as well as the inferior crater prevention during cathodic electrophoretic deposition. According to the present invention, by applying an Fe-P plating as defined above to a zinc or zinc alloy plated steel strip, the phosphate film formed during the subsequent phosphate treatment is modified into a film of phosphophyllite $Zn_2Fe(PO_4)_2.4H_2O$, which is highly effective in improving the crater prevention during cathodic electrophoretic deposition and the secondary wet adhesion of a coating layer.

The build-up of the Fe-P plating to be deposited on a zinc or zinc alloy plated steel strip is preferably at least 0.5 g/m$^2$. In order to improve the secondary wet adhesion of paint coating and the crater prevention during cathodic electrophoretic deposition, it is a key to convert the film resulting from phosphate treatment into a film of phosphophyllite. With build-ups of Fe-P plating of less than 0.5 g/m$^2$, phosphophyllite is formed in an amount insufficient to achieve the desired effect. In some embodiments, the upper limit of 8 g/m$^2$ is imposed on the Fe-P plating because a substantial quantity of a thicker Fe-P plating might be left unconverted upon its conversion into phosphophyllite during phosphate treatment.

In one preferred embodiment of the present invention, one element selected from the group consisting of Ni, Zn, Mn, and Ti is deposited to a build-up of 5 to 50 mg/m$^2$ on the Fe-P plating layer which is previously deposited on a zinc or zinc alloy plated steel strip. This metallic topcoat containing numerous microcells at the surface facilitates chemical conversion with phosphate. The metallic topcoat in a build-up of less than 5 mg/m$^2$ is not effective. With build-ups of more than 50 mg/m$^2$ the elemental topcoat entirely and uniformly covers the surface to leave few microcells and is left in the phosphate film in the form of phosphate salt, undesirably reducing the ratio of phosphophyllite to phosphophyllite plus hopeite. Similar results will be obtained when phosphorus in the Fe-P plating according to the present invention is replaced by another element in the same Periodic Group, that is, As, Sb or Bi.

Next, the phosphate treated steel strip prepared by subjecting the Fe-P plated steel strip to phosphate treatment or bonderizing according to the third aspect of the present invention will be described.

More specifically, the phosphate treated steel strip is prepared by subjecting a steel strip having an uppermost layer of an Fe-P system with a phosphorus content of 0.0003 to 15% by weight electrodeposited thereon to a phosphate treatment or bonderizing. The phosphate treated steel strip exhibits improved corrosion resistance without paint coating probably for the following reason.

FIGS. *2a* and *2b* are scanning electron microscope (SEM) photographs of the phosphate treated steel strip according to the present invention and a phosphate treated cold rolled steel strip, respectively. Crystals of chemically converted phosphate on the cold rolled strip are as rough as 14 micrometers while crystals on the phosphate treated steel strip according to the present invention are as fine as 2.5 micrometers and form a dense film over the steel surface. Because of the denseness of crystals, the phosphate film according to the present invention is free of pinholes, firmly bonded and has improved corrosion resistance as opposed to conventional phosphate films. Some phosphorus contained in the Fe-P plating is oxidized into phosphoric acid which acts as an inhibitor at the plating surface. Since the firmly bonded phosphate film is present on the plating surface, freshly formed phosphoric acid is retained on the plating surface such that its effect is fully exerted, resulting in outstanding improvement in corrosion resistance without paint coating. As long as the content of phosphorus in the iron plating is at least 0.0003% by weight, phosphate treated steel strips exhibit improved corrosion resistance. The corrosion resistance increases with an increase in phosphorus content, reaches the maximum at phosphorus contents of about 0.5% by weight, and then remains at a constant high level. The upper limit is set to 15% by weight. Although phosphorus contents exceeding 15% by weight do not adversely affect the corrosion resistance without paint coating, electric current efficiency is lowered to undesirably increase the operating cost in actual manufacture lines. An increase in the amount of phosphorus compound added to the treating solution is also undesirable in economy.

When the Fe-P plating is applied onto a zinc or zinc alloy plating on the steel, the Fe-P plating should be at least 0.5 g/m$^2$.

As described above, the phosphate treated, Fe-P plated steel strips according to the present invention have significantly improved corrosion resistance without paint coating. When flaws reach the underlying steel through the paint and plating layers, the intervening zinc or zinc alloy provides electrochemical protective action to the underlying steel, minimizing red rust formation. In addition, the corrosion products of zinc affords protective action, improving corrosion resistance without paint coating at no sacrifice of the effect of Fe-P plating.

Although the foregoing description refers to steel strips plated with Fe-P followed by phosphate treatment, similar results are obtained when the Fe-P plating layer further contains an inevitable proportion of one or more elements selected from Zn, Cu, Ni, Cr, Co, Mn, V, Sn, Cd and the like.

The phosphate treating or bonderizing solution which can be used herein may be selected from conventional treating solutions which principally contain phosphate ion, zinc ion, alkali metal ion, heavy metal ion, and accelerators. Such typical examples are phosphate treating solutions of dip and spray types including Bonderite 3030 (trade name, manufactured and sold by Nihon Parkerizing K.K., Japan) and Granodine SD 2000 and 16NC (trade name, manufactured and sold by Nihon Paint K.K., Japan). The steel strips according to the present invention ensure, as phosphate treated, excellent corrosion resistance without paint coating, and exhibit further improved corrosion resistance without paint coating when the phosphate treatment is followed by chromate treatment for sealing.

As opposed to Fe-Zn platings liable to be nonuniform, the Fe-P plating is relatively easy to form a uniform layer which ensures that the final phosphate film be uniform and good in appearance. This is one of the great advantages of the present invention.

Next, the process for making such Fe-P plated steel strips will be described.

According to the process of the present invention, a steel strip is electroplated on at least one surface thereof with Zn or Zn alloy layer and then with an Fe-P system alloy containing 0.0003% to 15% by weight of phosphorus. A plating bath containing $Fe^{2+}$ ions in an amount of from 0.3 mol/liter up to the solubility limit and hypophosphorous acid or a hypophosphite in an amount of 0.001 to 25 g/liter as expressed in $NaH_2PO_2 \cdot H_2O$ is used at a pH of 1.0 to 5.0 and a temperature of 30° to 60° C. while electroplating is carried out with a current density of from more than 20 to 200 A/dm$^2$.

The basic plating bath may be selected from chloride baths, sulfate baths, and mixed baths well known in the art. The ferrous ($Fe^{2+}$) ions in the bath is available either in the form of a compound such as ferrous chloride $FeCl_2 \cdot nH_2O$ and ferrous sulfate $FeSO_4 \cdot 7H_2O$ or by dissolving metallic iron. Conduction aids may be added to increase electric conductivity and critical current density and reduce solution resistance, and they may be added to the solubility limit, for example, KCl, $NH_4Cl$, NaCl, $CaCl_2$, $Na_2SO_4$, $(NH_4)_2SO_2$, etc.

The concentration of ferrous ($Fe^{2+}$) ions ranges from 0.3 mol/liter, and preferably from 1.0 mol/liter to the solubility limit. Burnt deposits often form at concentrations below the lower limit.

The amount of $NaH_2PO_2 \cdot H_2O$ is limited to the range of 0.001 to 25 g/liter which ensures deposition of an Fe-P plating having a phosphorus content of 0.0003 to 15% by weight. The phosphorus source may include a wide variety of phosphoric acids and salts thereof, the preferred source being hypophosphorous acid or a hypophosphite.

The pH of the bath is in the range of 1.0 to 5.0, and preferably 1.5 to 4.0 because cathodic deposition efficiency is lowered at lower pH and precipitation of iron hydroxide resulting from oxidation of $Fe^{2+}$ becomes excessive at higher pH.

The bath temperature is in the range of 30° to 60° C. because the ingredients become less soluble at lower temperatures and excessive oxidation of $Fe^{2+}$ and $P^-$ occurs as higher temperatures.

The current density is in the range of from more than 20 to 200 A/dm$^2$, and preferably from 40 to 150 A/dm$^2$. With lower current densities, platings of poor appearance (discolored and nonuniform) are deposited in low yields. eventually detracting from phosphatability. Contrarily, higher current densities cause platings to be burnt and reduce cathodic deposition efficiency.

In order that those skilled in the art will more readily understand how to practice the present invention, examples of the present invention will be presented by way of illustration and not by way of limitation. In the following description, g/l is gram per liter, A/dm$^2$ is ampere per square decimeter, and C/m$^2$ is coulomb per square meter.

[I] Fe-P plating with a P content of 0.0003 to 0.5 wt%

Cold rolled steel strips were electrolytically degreased and pickled in a conventional manner before an Fe-P plating was applied to them under the following conditions. For some strips, an elemental metal, Ni, Zn, Mn or Ti was applied onto the Fe-P plating layer by a flash plating technique. The resultant Fe-P plated steel strips were subjected to the following tests. The results are shown in Table 1.

| (1) Fe—P plating | | |
|---|---|---|
| (1-1) | Bath composition | |
| | $FeCl_2$ | 150 g/l |
| | KCl | 200 g/l |
| | Citric acid | 10 g/l |
| | $NaH_2PO_2 \cdot H_2O$ | 0.001–2 g/l |
| (1-2) | Plating conditions | |
| | pH | 3.0 |
| | Bath temperature | 50° C. |
| | Current density | 40–150 A/dm$^2$ |

The concentration of $NaH_2PO_2$ and the current density were changed to control the P content.

| (2) Flash plating | | |
|---|---|---|
| (2-1) | Ni plating | |
| | Bath composition | |
| | $NiSO_4$ | 250 g/l |
| | $NiCl_2$ | 45 g/l |
| | Boric acid | 30 g/l |
| | Plating conditions | |
| | pH | 3.5 |
| | Bath temperature | 60° C. |
| | Anode | Ni plate |
| | Electricity | 28 C/m$^2$ |
| (2-2) | Zn plating | |
| | Bath composition | |
| | $ZnCl_2$ | 210 g/l |
| | KCl | 360 g/l |
| | Plating conditions | |
| | pH | 5.0 |
| | Bath temperature | 50° C. |
| | Anode | Zn plate |

-continued

| (2) Flash plating | |
|---|---|
| Electricity | 60 C/m$^2$ |
| (2-3) Mn plating | |
| Bath composition | |
| $MnSO_4.4H_2O$ | 150 g/l |
| $(NH_4)_2SO_4$ | 100 g/l |
| $Na_2SO_3$ | 2 g/l |
| Glycine | 15 g/l |
| Plating conditions | |
| pH | 3 |
| Bath temperature | 20° C. |
| Anode | Insoluble carbon |
| Electricity | 110 C/m$^2$ |
| (2-4) Ti plating | |

Plating was carried out by immersing for 5 seconds a strip in a bath containing 0.001 mol/liter of $K_2TiO_3$ at room temperature.

Additionally, Fe-P platings were applied under the following conditions onto steel strips which had previously been electroplated with Zn, Zn-Fe alloy, Zn-Ni alloy and Zn-Al alloy in an ordinary manner. For some strips, an elemental metal, Ni, Zn, Mn or Ti was applied to the Fe-P plating layer by a flash plating technique. The resultant Fe-P plated steel strips were subjected to the following tests. The results are shown in Table 2.

| (1) Fe—P plating | |
|---|---|
| (1-1) Bath composition | |
| $FeCl_2$ | 200 g/l |
| KCl | 200 g/l |
| Citric acid | 20 g/l |
| $NaH_2PO_2.H_2O$ | 0.001-2 g/l |
| (1-2) Plating conditions | |
| pH | 3.0 |
| Bath temperature | 50° C. |
| Current density | 40-150 A/dm$^2$ |

The concentration of $NaH_2PO_2$ in the bath and the current density were changed to control the P content.

(2) Flash plating

Plating was carried out as described above.

PHOSPHATE TREATMENT

The plated steel strips were degreased, rinsed and surface conditioned under standard conditions corresponding to the phosphate treating solutions before they were subjected to phosphate treatment, rinsed with water, and dried. The phosphate treating solutions used are Bonderite 3030 (trade name of dip type phosphate solution, manufactured and sold by Nihon Parkerizing K.K., Japan), Bonderite 3128 (trade name of spray type phosphate solution, manufactured and sold by Nihon Parkerizing K.K.), and Granodine SD 2000 (trade name of dip type phosphate solution, manufactured and sold by Nihon Paint K.K., Japan).

(1) Etched quantity

An etched quantity was determined by the weight of a degreased specimen minus the weight of the phosphated specimen from which the phosphate film was dissolvd away.

(2) Film weight

The weight of the phosphate film was determined by dissolving away the film with a 5% chromic acid solution.

(3) P proportion

The proportion of phosphophyllite relative to hopeite was determined by the formula:

$$\frac{\text{Phosphophyllite peak}}{\text{Phosphophyllite peak + Hopeite peak}} \times 100\%$$

where Phosphophyllite and Hopeite peaks means the peak heights of phosphophyllite and hopeite in X ray analysis, respectively.

(4) Crystal size

After ordinary phosphate treatment, the phosphate film was observed under a scanning electron microscope (SEM) to determine the size of crystals. The maximum lengths of crystals are averaged.

(5) Corrosion resistance of phosphated steel without paint coating.

A phosphate treated specimen was sealed at its edges and subjected to a salt spray test according to JIS Z 2371. The corrosion resistance without paint coating was evaluated in terms of the time required for red rust to spread in excess of 10% of the surface area.

(6) Secondary wet adhesion of paint coating

A phosphate treated specimen was coated with an under coat of 20 μm by cathodic electrophoretic deposition, a sealer coat, and a top coat to a total coating thickness of 90 to 100 μm. The coated specimen was immersed in water at 40° C. for 10 days. Immediately after removal from water, the specimen was scribed in mutually perpendicular directions to a depth reaching the underlying steel to define one hundred (100) square areas of 2 mm×2 mm and an adhesive tape was applied to the scribed coating. The adhesive tape was removed to determine the number of coating pieces separated.

(7) Corrosion resistance

A phosphate treated specimen was coated to a total coating thickness of 90 to 100 μm in the same manner as described for the wet adhesion test. The coated specimen was cross cut to a depth reaching the underlying steel, and then subjected to one hundred (100) cycles of salt water dip test, each cycle consisting of immersing in 5% sodium chloride in water for 15 minutes, drying for 75 minutes at room temperature, and holding for 22.5 hours in a moisture box at a temperature of 49° C. and a relative humidity of 85%. Blisters grew from the cross cuts during the test. The width of blisters in mm was measured and the flow of rust was observed.

(8) Crater prevention

A cathodic electrophoretic deposition solution, U-30 (trade name, manufactured and sold by Nihon Paint K.K.) was prepared and stirred for one week. Using this solution, specimens were electrophoretically painted under conditions: electrode distance 4 cm; voltage 350 volts; and deposition time 180 seconds without soft touch. Evaluation was made according to the following criterion.

| | Number of craters, /cm$^2$ |
|---|---|
| ◎ (excellent) | none |
| ○(good) | 1-5 |
| Δ (fair) | 6-20 |
| X (rejected) | more than 20 |

As evident from the results shown in Tables 1 to 2, steel strips are improved in phosphatability by applying an Fe-P plating having a phosphorus content of 0.0003 to 0.5% by weight of the plating onto the steel strips directly or via a plating of zinc or zinc alloy according to the present invention.

TABLE 1

| Example | Fe—P plating: Composition (P content %) | Fe—P plating: Build-up ($g/m^2$) | Flash plating ($mg/m^2$) | Phosphate treatment: Solution | Phosphate treatment: Initial number of crystal nuclei ($\times 10^5/cm^2$) | Phosphate treatment: Immersion time (sec.) |
|---|---|---|---|---|---|---|
| A1 | 0.02 | 2.1 | — | Granodine SD-2000 | 10.5 | 120 |
| A2 | 0.0003 | 0.5 | — | Bonderite 3004 | 2.3 | " |
| A3 | 0.05 | 2.5 | — | " | 10.8 | " |
| A4 | 0.5 | 0.7 | — | " | 2.2 | " |
| A5 | 0.05 | 2.1 | — | Granodine SD-2000 | 11.0 | " |
| A6 | 0.05 | 2.1 | — | " | 10.5 | " |
| A7 | 0.05 | 2.1 | — | Bonderite 3030 | 10.0 | " |
| A8* | none | nil | — | Bonderite 3004 | 1.0 | " |
| A9* | none | nil | — | Granodine SD-2000 | 1.1 | " |
| A10* | none | nil | — | " | 5.0 | " |
| A11 | 0.05 | 2 | Ni 7 | Bonderite 3030 | 13.0 | " |
| A12 | 0.02 | 2 | Zn 20 | " | 15.1 | " |
| A13 | 0.02 | 2 | Mn 30 | " | 15.5 | " |
| A14 | 0.05 | 2 | Ti 5 | " | 12.5 | " |

| Example | Phosphate film: Etched quantity ($g/m^2$) | Phosphate film: Film weight ($g/m^2$) | Phosphate film: P proportion (%) | Crystal size (μm) | Corrosion resistance of phosphated steel without coating (hr.) | Paintability: Wet adhesion | Paintability: Corrosion resistance |
|---|---|---|---|---|---|---|---|
| A1 | 1.8 | 2.5 | 100 | 2.5 | 18 | 0/100 | 1 no red rust |
| A2 | 0.7 | 1.6 | 90 | 5.0 | 8 | " | 2 " |
| A3 | 2.5 | 2.6 | 100 | 2.6 | 18 | " | 1 " |
| A4 | 0.9 | 1.7 | 95 | 3.2 | 24 | " | 1 " |
| A5 | 1.9 | 2.5 | 100 | 2.8 | 18 | " | 1 " |
| A6 | 2.0 | 2.5 | 100 | 2.7 | 18 | " | 1 " |
| A7 | 2.0 | 2.5 | 100 | 2.6 | 18 | " | 1 " |
| A8* | 0.3 | 0.8 | 100 | 11.0 | 4 | " | 3 considerable red rust |
| A9* | 1.0 | 2.6 | 90 | 14.0 | 4 | " | 1 considerable red rust |
| A10* | 0.8 | 1.9 | 100 | 14.0 | 4 | " | 1 considerable red rust |
| A11 | 1.5 | 2.3 | 95 | 2.8 | 18 | " | 1 no red rust |
| A12 | 1.5 | 2.3 | 90 | 2.8 | 18 | " | 1 " |
| A13 | 1.5 | 2.3 | 95 | 2.6 | 18 | " | 1 " |
| A14 | 1.5 | 2.3 | 100 | 2.6 | 18 | " | 1 " |

Comperative example

TABLE 2

| Example | Lower layer: Plating** | Lower layer: Build-up ($g/m^2$) | Upper layer of Fe—P plating: P content (wt %) | Upper layer of Fe—P plating: Build-up ($g/m^2$) | Flash plating ($mg/m^2$) | Phosphate treatment: Solution | Phosphate treatment: Initial number of crystal nuclei ($\times 10^5/cm^2$) |
|---|---|---|---|---|---|---|---|
| B1 | E. Zn | 20 | 0.02 | 2.1 | — | Granodine SD-2000 | 10.5 |
| B2 | E. Zn—Fe (Fe 20%) | 20 | 0.0003 | 0.5 | — | Bonderite 3004 | 2.3 |
| B3 | E. Zn—Fe (Fe 20%) | 20 | 0.05 | 2.5 | — | " | 10.8 |
| B4 | E. Zn—Fe (Fe 20%) | 20 | 0.5 | 0.7 | — | " | 2.2 |
| B5 | E. Zn—Ni (Ni 12%) | 20 | 0.05 | 2.1 | — | Granodine SD-2000 | 11.0 |
| B6 | E. Zn—Al (Al 17%) | 30 | 0.05 | 2.1 | — | " | 10.5 |
| B7 | Galvanized Zn | 90 | 0.05 | 2.1 | — | Bonderite 3030 | 10.0 |
| B8* | E. Zn—Fe (Fe 20%) | 20 | none | nil | — | Bonderite 3004 | 1.0 |
| B9* | E. Zn | 20 | none | nil | — | Granodine SD-2000 | 15.0 |
| B10 | E. Zn—Fe (Fe 15%) | 20 | 0.05 | 2 | Ni 7 | Bonderite 3030 | 13.0 |
| B11 | E. Zn—Fe (Fe 15%) | 20 | 0.02 | 2 | Zn 20 | " | 15.1 |
| B12 | E. Zn—Fe (Fe 20%) | 20 | 0.02 | 2 | Mn 30 | " | 15.5 |
| B13 | E. Zn—Fe (Fe 20%) | 20 | 0.05 | 2 | Ti 5 | " | 12.5 |

| Example | Immersion (sec.) | Etched quantity ($g/m^2$) | Phosphate film: Film weight ($g/m^2$) | Phosphate film: P proportion (%) | Phosphate film: Crystal size (μm) | Corrosion resistance of phosphated steel without coating (hr) | Paintability: Wet adhesion | Paintability: Crater prevention | Paintability: Corrosion resistance |
|---|---|---|---|---|---|---|---|---|---|
| B1 | 120 | 1.8 | 2.5 | 100 | 2.8 | 216 | 0/100 | ◎ | 1 no red rust |
| B2 | " | 0.7 | 1.6 | 90 | 3.4 | 240 | " | ○ | 2 " |
| B3 | " | 2.5 | 2.6 | 100 | 2.5 | 360 | " | ◎ | 1 " |
| B4 | " | 0.9 | 1.7 | 95 | 2.9 | 480 | " | ○ | 1 " |
| B5 | " | 1.9 | 2.5 | 100 | 2.6 | 456 | " | ◎ | 1 " |
| B6 | " | 2.0 | 2.5 | 100 | 2.7 | 720 | " | ◎ | 1 " |
| B7 | " | 2.0 | 2.5 | 100 | 2.8 | 480 | " | ◎ | 1 " |
| B8* | " | 0.3 | 0.8 | 100 | 11.2 | 48 | " | ◎ | 3 considerable red rust |
| B9* | " | 4.5 | 5.7 | 0 | 15.4 | 24 | 95/100 | Δ | 6 considerable white rust |
| B10 | " | 1.5 | 2.3 | 95 | 2.8 | 360 | 0/100 | ◎ | 1 no red rust |

TABLE 2-continued

| | | | | | | | | |
|---|---|---|---|---|---|---|---|---|
| B11 | " | 1.5 | 2.3 | 90 | 3.1 | 336 | " | 1 " |
| B12 | " | 1.5 | 2.3 | 95 | 3.1 | 312 | " | 1 " |
| B13 | " | 1.5 | 2.3 | 100 | 2.8 | 360 | " | 1 " |

*Comparative example
**E. = electroplated

[II] Fe-P plating with a P content of 0.5% to 15% by weight

Cold rolled steel strips were electrolytically degreased and pickled in conventional manner before an Fe-P plating was applied to them under the following conditions. For some strips, an elemental metal, Ni, Zn Mn or Ti was applied onto the Fe-P plating layer by a flash plating technique. The resultant Fe-P plated steel strips were subjected to the following tests. The results are shown in Table 3 and FIGS. *2a* and *2b*.

| (1) Fe—P plating | | |
|---|---|---|
| (1-1) | Bath composition | |
| | $FeCl_2$ | 150 g/l |
| | KCl | 200 g/l |
| | Citric acid | 10 g/l |
| | $NaH_2PO_2.H_2O$ | 0.001-25 g/l |
| (1-2) | Plating conditions | |
| | pH | 3.0 |
| | Bath temperature | 50° C. |
| | Current density | 40-150 A/dm$^2$ |

The concentration of $NaH_2PO_2$ and the current density were changed to control the P content.

| (2) Flash plating | | |
|---|---|---|
| (2-1) | Ni plating | |
| | Bath composition | |
| | $NiSO_4$ | 250 g/l |
| | $NiCl_2$ | 45 g/l |
| | Boric acid | 30 g/l |
| | Plating conditions | |
| | pH | 3.5 |
| | Bath temperature | 60° C. |
| | Anode | Nickel plate |
| | Electricity | 28 C/m$^2$ |
| (2-2) | Zn plating | |
| | Bath composition | |
| | $ZnCl_2$ | 210 g/l |
| | KCl | 360 g/l |
| | Plating conditions | |
| | pH | 5.0 |
| | Bath temperature | 50° C. |
| | Anode | Zn plate |
| | Electricity | 60 C/m$^2$ |
| (2-3) | Mn plating | |
| | Bath composition | |
| | $MnSO_4.4H_2O$ | 150 g/l |
| | $(NH_4)_2SO_4$ | 100 g/l |
| | $Na_2SO_3$ | 2 g/l |
| | Glycine | 15 g/l |
| | Plating conditions | |
| | pH | 3 |
| | Bath temperature | 20° C. |
| | Anode | Insoluble carbon |
| | Electricity | 110 C/m$^2$ |
| (2-4) | Ti plating | |

Plating was carried out by immersing for 5 seconds a strip in a bath containing 0.001 mol/liter of $K_2TiO_3$ at room temperature.

Additionally, Fe-P platings were applied under the following conditions onto steel strips which had previously been electroplated with Zn, Zn-Ni alloy and Zn-Fe alloy in an ordinary manner. For some strips, an elemental metal, Ni, Zn, Mn or Ti was applied to the Fe-P plating layer by a flash plating technique. The resultant Fe-P plated steel strips were subjected to the following tests. The results are shown in Table 4.

| (1) Fe—P plating | | |
|---|---|---|
| (1-1) | Bath composition | |
| | $FeCl_2$ | 200 g/l |
| | KCl | 200 g/l |
| | Citric acid | 20 g/l |
| | $NaH_2PO_2.H_2O$ | 0.001-25 g/l |
| (1-2) | Plating conditions | |
| | pH | 3.0 |
| | Bath temperature | 50° C. |
| | Current density | 40-150 A/dm$^2$ |

The concentration of $NaH_2PO_2$ in the bath and the current density were changed the P content.

(2) Flash plating

Plating was carried out as described above.

PHOSPHATE TREATMENT

The plated steel strips were degreased, rinsed and surface conditioned under standard conditions corresponding to the phosphate treating solutions before they were subjected to phosphate treatment, rinsed with water, and dried. The phosphate treating solutions used are Bonderite 3030 (trade name of dip type phosphate solution, manufactured and sold by Nihon Parkerizing K.K., Japan), Bonderite 3128 (trade name of spray type phosphate solution, manufactured and sold by Nihon Parkerizing K.K.), and Granodine SD 2000 (trade name of dip type phosphate solution, manufactured and sold by Nihon Paint K.K., Japan).

(1) Crystal size

Specimens were phosphate treated in a usual manner and observed under a scanning electron microscope (SEM) to determine the size of crystals. A mean value of the maximum lengths of crystals was determined.

FIGS. *2a* and *2b* are SEM photographs of a specimen according to the present invention and a specimen phosphate treated without Fe-P plating, respectively.

(2) Film weight

The weight of the phosphate film was determined by dissolving away the film with a 5% chromic acid solution.

(3) P proportion

The proportion of phosphophyllite relative to hopeite was determined by the formula:

$$\frac{\text{Phosphophyllite peak}}{\text{Phosphophyllite peak} + \text{Hopeite peak}} \times 100\%$$

where Phosphophyllite and Hopeite peaks mean the peak heights of phosphophyllite and hopeite in X ray analysis, respectively.

(4) Wet adhesion of paint coating

A phosphate treated specimen was coated with an under coat of °μm by cathodic electrophoretic deposition, a sealer coat, and an overcoat to a total coating thickness of 90 to 100 μm. The coated specimen was immersed in water at 40° C. for 10 days. Immediately after removal from water, the specimen was scribed in mutually perpendicular directions to a depth reaching the underlying steel to define one hundred (100) square areas of 2 mm×2 mm and an adhesive tape was applied to the scribed coating. The adhesive tape was removed to determine the number of coating pieces separated.

(5) Blister prevention

A phosphate treated specimen was coated to a total coating thickness of 90 to 100 μm in the same manner as described for the secondary adhesion test. The coated specimen was cross cut to a depth reaching the underlying steel, and then subjected to one hundred (100) cycles of salt water dip test, each cycle consisting of immersing in 5% sodium chloride in water for 15 minutes, drying for 75 minutes at room temperature, and holding for 22.5 hours in a moisture box at a temperature of 49° C. and a relative humidity of 85%. Blisters grew from the cross cuts during the test. The width of blisters in mm was measured.

(6) Crater prevention

A cathodic electrophoretic deposition solution, U-30 (trade name, manufactured and sold by Nihon Paint K.K.) was prepared and stirred for one week. Using this solution, specimens were electrophoretically painted under conditions: electrode distance 4 cm; voltage 350 volts; and deposition time 180 seconds without soft touch. Evaluation was made according to the following criterion.

| | Number of craters, /cm$^2$ |
|---|---|
| ◎ (excellent) | none |
| ○(good) | 1–5 |
| Δ (fair) | 6–20 |
| X (rejected) | more than 20 |

As evident from the results shown in Tables 3 and 4 and FIGS. *2a* and *2b*, steel strips are improved in phosphatability by applying an Fe-P plating having a phosphorus content of 0.5% to 15.0% by weight of the plating onto the steel strips directly or via a plating of zinc or zinc alloy according to the present invention.

TABLE 3

| | Fe—P plating | | Flash plating | Phosphate treatment | | | | Paint ability | | |
|---|---|---|---|---|---|---|---|---|---|---|
| Example | P content (%) | Build-up (g/m$^2$) | Build-up (mg/m$^2$) | Solution | Crystal size (μm) | Film weight (g/m$^2$) | P proportion (%) | Wet adhesion | Crater prevention | Blister prevention |
| C1 | 0.6 | 0.9 | — | Bonderite 3128 | 3.5 | 2.1 | 90 | 0/100 | | 1 |
| C2 | 1.1 | 1.5 | — | Bonderite 3128 | 3.3 | 2.0 | 90 | 0/100 | | 1 |
| C3 | 2.5 | 0.03 | — | Granodine SD2000 | 2.7 | 2.2 | 100 | 0/100 | | 1 |
| C4 | 4.8 | 0.2 | — | Granodine SD2000 | 3.2 | 1.9 | 95 | 0/100 | | 1 |
| C5 | 0.9 | 4.5 | — | Granodine SD2000 | 2.5 | 2.2 | 100 | 0/100 | | 1 |
| C6* | 0 | 2.0 | — | Bonderite 3128 | 15.0 | 0.8 | 35 | 30/100 | | 3 |
| C7* | 0.7 | 0.005 | — | Granodine SD2000 | 9.0 | 2.5 | 90 | 0/100 | | 1 |
| C8* | — | — | — | Granodine SD2000 | 14.0 | 2.6 | 90 | 0/100 | | 1 |
| C9 | 0.8 | 1.0 | Ni 7 | Bonderite 3030 | 2.7 | 1.9 | 95 | 0/100 | | 1 |
| C10 | 1.4 | 0.5 | Mn 20 | Bonderite 3030 | 2.6 | 2.3 | 95 | 0/100 | | 1 |
| C11 | 2.9 | 0.5 | Zn 20 | Bonderite 3030 | 2.9 | 2.3 | 100 | 0/100 | | 1 |
| C12 | 0.6 | 2.0 | Ti 4 | Bonderite 3030 | 2.4 | 2.3 | 100 | 0/100 | | 1 |
| C13 | 8.5 | 0.6 | — | Bonderite 3030 | 3.8 | 1.8 | 95 | 0/100 | | 1 |
| C14 | 14.3 | 2.0 | — | Bonderite 3030 | 3.1 | 2.4 | 100 | 0/100 | | 1 |

*comparative examples

TABLE 4

| | Lower plating | | Fe—P Plating | | Flash plating | |
|---|---|---|---|---|---|---|
| Example | Type** | Build-up (g/m$^2$) | P content (%) | Build-up (g/m$^2$) | Build-up (mg/m$^2$) | Solution |
| D1 | E. Zn | 20 | 0.6 | 1.5 | — | Bonderite 3128 |
| D2 | Galvanized Zn | 120 | 2.4 | 7.0 | — | Bonderite 3128 |
| D3 | Galvannealed Zn | 45 | 4.9 | 3.1 | — | Granodine SD2000 |
| D4 | E. Zn—Fe (15%) | 20 | 1.2 | 2.0 | — | Granodine SD2000 |
| D5 | E. Zn—Fe (15%) | 20 | 13.5 | 3.5 | — | Bonderite 3030 |
| D6 | E. Zn—Ni (12%) | 20 | 0.9 | 0.9 | — | Bonderite 3030 |
| D7* | E. Zn | 20 | — | — | — | Bonderite 3030 |
| D8* | E. Zn—Fe (15%) | 20 | 0 | 2.5 | — | Bonderite 3030 |
| D9* | E. Zn—Ni (12%) | 20 | 0.6 | 0.05 | — | Bonderite 3030 |
| D10 | E. Zn | 20 | 0.8 | 1.4 | Ni 6 | Bonderite 3030 |
| D11 | E. Zn—Fe (15%) | 20 | 1.3 | 1.0 | Mn 30 | Bonderite 3030 |
| D12 | E. Zn—Fe (20%) | 30 | 2.7 | 4.1 | Zn 15 | Bonderite 3030 |
| D13 | E. Zn—Ni (12%) | 20 | 0.7 | 2.1 | Ti 5 | Bonderite 3030 |

| | Phosphate treatment | | | Paint ability | | |
|---|---|---|---|---|---|---|
| Example | Crystal size (μm) | Film weight (g/m$^2$) | P proportion (%) | Wet adhesion | Crater prevention | Blister prevention |
| D1 | 3.4 | 2.3 | 90 | 0/100 | ◎ | 1 |
| D2 | 3.2 | 2.1 | 90 | 0/100 | ◎ | 1 |
| D3 | 3.1 | 1.9 | 95 | 0/100 | ◎ | 1 |
| D4 | 2.9 | 2.0 | 100 | 0/100 | ◎ | 1 |
| D5 | 3.5 | 2.5 | 100 | 0/100 | ◎ | 1 |
| D6 | 2.5 | 2.2 | 100 | 0/100 | ◎ | 1 |
| D7* | 14.0 | 3.9 | 0 | 100/100 | Δ | 5 |
| D8* | 11.0 | 0.9 | 50 | 40/100 | | 3 |
| D9* | 9.0 | 3.2 | 5 | 100/100 | X | 3 |

TABLE 4-continued

| | | | | | | |
|---|---|---|---|---|---|---|
| D10 | 3.0 | 2.0 | 95 | 0/100 | ◎ | 1 |
| D11 | 3.1 | 2.1 | 95 | 0/100 | ◎ | 1 |
| D12 | 2.8 | 2.4 | 95 | 0/100 | ◎ | 1 |
| D13 | 2.9 | 2.2 | 100 | 0/100 | ◎ | 1 |

*comparative examples
**E. = electroplated

[III] Chemically Treated Fe-P Plated Steel

The following examples demonstrate that steel strips which are plated with an Fe-P plating as described above and then chemically treated with a phosphate exhibit improved corrosion resistance without paint coating.

EXAMPLE E1

Cold rolled steel strips were electrolytically degreased and pickled in a conventional manner before an Fe-P plating was applied to them under the following conditions.

| | |
|---|---|
| Bath composition | |
| $FeSO_4.7H_2O$ | 140 g/l |
| $(NH_4)_2SO_4$ | 100 g/l |
| KCl | 20 g/l |
| $NaH_2PO_2.H_2O$ | 0.1–25 g/l |
| Plating conditions | |
| pH | 2.5 |
| Bath temperature | 50° C. |
| Current density | 40–100 A/dm$^2$ |

The thus plated steel strips were treated with Granodine SD 2000 (dip type) in a usual manner.

EXAMPLE E2

Fe-P platings were applied to Zn electroplated steel strips, Zn-Ni alloy electroplated steel strips, galvanized steel strips, and galvannealed steel strips under the following conditions. (Electroplating, galvanizing and galvannealing were as usual.)

| | |
|---|---|
| Bath composition | |
| $FeCl_2.nH_2O$ | 200 g/l |
| KCl | 150 g/l |
| $NaH_2PO_2.H_2O$ | 0.5–25 g/l |
| Plating conditions | |
| pH | 3.5 |
| Bath temperature | 50° C. |
| Current density | 40–100 A/dm$^2$ |

EXAMPLE E3

Fe-P platings were applied to steel strips which were previously electroplated with a Zn-Fe plating in a usual manner.

| | |
|---|---|
| Bath composition | |
| $FeSO_4.7H_2O$ | 250 g/l |
| $(NH_4)_2SO_4$ | 150 g/l |
| $NaH_2PO_2.H_2O$ | 0.4 g/l |
| Plating conditions | |
| pH | 4 |
| Bath temperature | 40° C. |
| Current density | 60 A/dm$^2$ |

Thereafter, a phosphate treatment was carried out in a usual manner using Granodine SD 2000.

The thus obtained treated steel strips were subjected to the following tests.

(1) Corrosion resistance without paint coating (after phosphate treatment)

A phosphate treated specimen was sealed at its edges and subjected to a salt spray test according to JIS Z 2371. The corrosion resistance without paint coating was evaluated in terms of the time required for red rust to spread in excess of 10% of the surface area.

(2) Wet adhesion

A phosphate treated specimen was triple coated with paints as described above and immersed for 10 days in pure water at 50° C. Immediately after removal from water, the specimens was scribed in mutually perpendicular directions to a depth reaching the underlying steel to define one hundred (100) square areas of 2 mm×2 mm and an adhesive tape was applied to the scribed coating. The adhesive tape was removed to determine the number of coating pieces separated.

(3) Crater prevention

A cathodic electrophoretic deposition solution, U-30 (trade name, manufactured and sold by Nihon Paint K.K.) was prepared and stirred for one week. Using this solution, specimens were electrophoretically painted under conditions: electrode distance 4 cm; voltage 350 volts; and deposition time 180 seconds without soft touch. Evaluation was made according to the following criterion.

| | Number of craters, /cm$^2$ |
|---|---|
| ◎ (excellent) | none |
| ○(good) | 1–5 |
| Δ (fair) | 6–20 |
| X (rejected) | more than 20 |

The results are shown in Table 5. As evident from Table 5, steel strips having a phosphate treated Fe-P plating as the uppermost layer according to the present invention exhibit improved corrosion resistance without paint coating as well as excellent corrosion resistance with paint coating.

Figure 3:
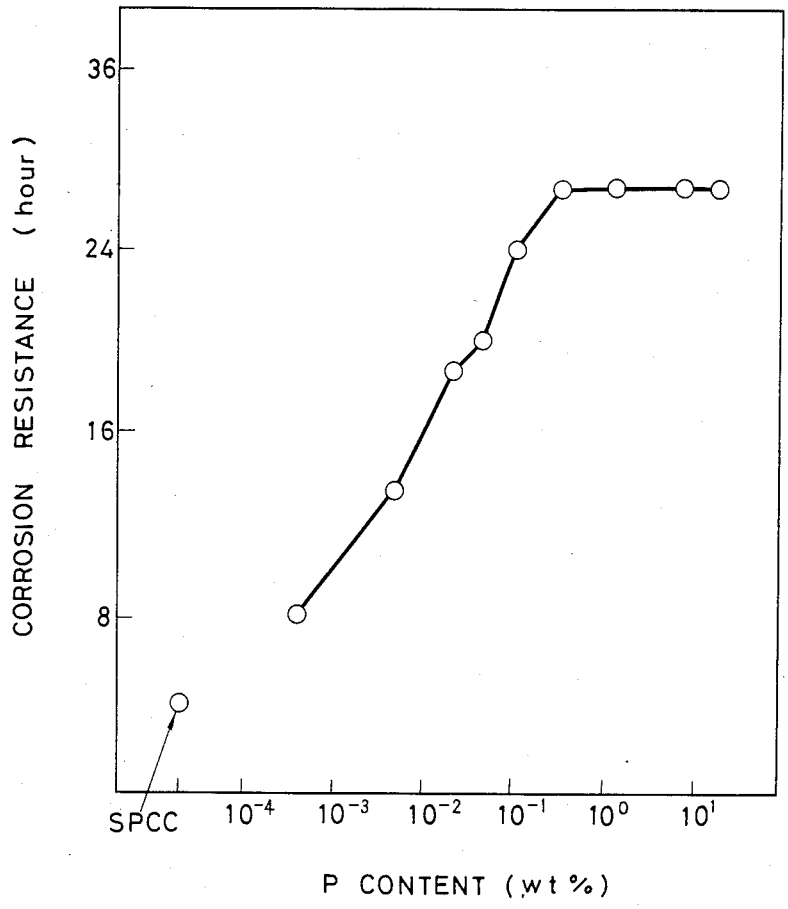
FIG. 3 is a graph showing P content vs corrosion resistance wherein Fe-P plated steel strips are prepared to varying P contents by changing the concentration of $NaH_2PO_2H_2O$ under the conditions of Example E1, treated with Granodine SD-2000, and subjected to a salt spray test, the corrosion resistance being expressed as the length of time required for the area of red rust to exceed 10%.

FIG. 3 is a graph showing P content vs corrosion resistance wherein Fe-P plated steel strips are prepared to varying P contents by changing the concentration of $NaH_2PO_2.H_2O$ under the conditions of Example E1, treated with Granodine SD-2000, and subjected to a salt spray test, the corrosion resistance being expressed as the length of time required for the area of red rust to exceed 10%.

Figure 4:
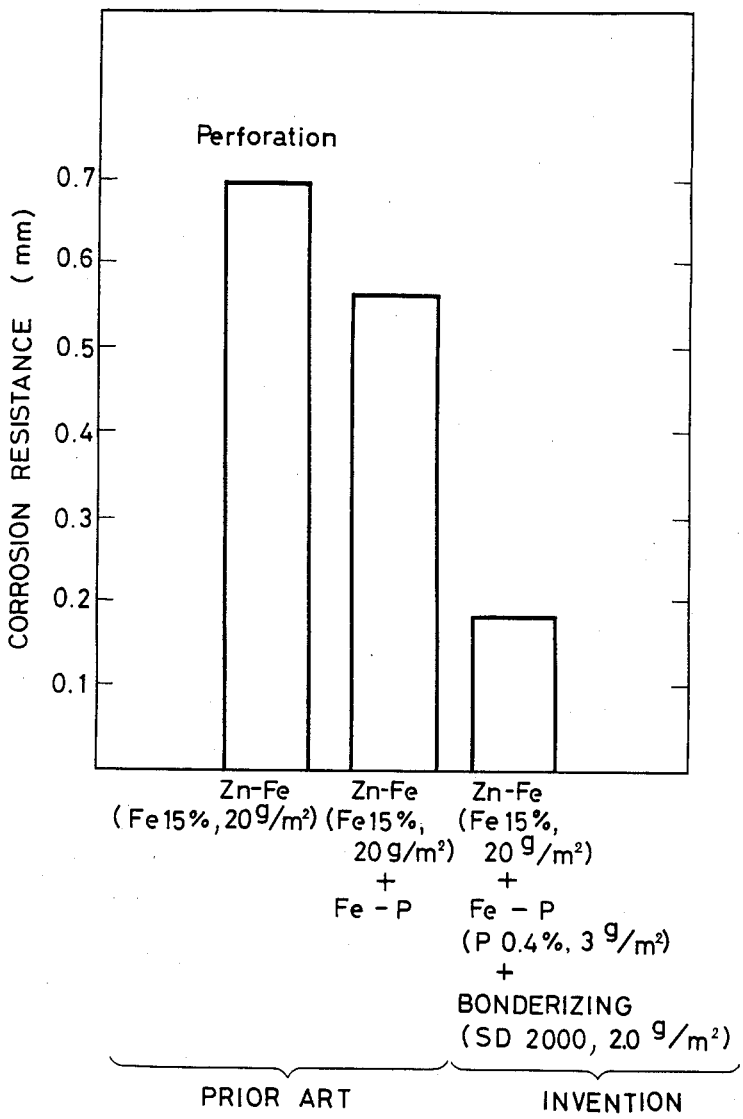
FIG. 4 is a graph showing the corrosion resistance of various plated steel strips wherein steel strips are plated and phosphate treated under the conditions of Example E3 and subjected to a 50 cycle test according to the salt spray testing procedure of JIS Z 2371, the corrosion resistance being expressed as a reduction in thickness measured using a point micrometer after removal of rust.

FIG. 4 is a graph showing the corrosion resistance of various plated steel strips wherein steel strips are plated and phosphate treated under the conditions of Example E3 and subjected to a 50 cycle test according to the salt spray testing procedure of JIS Z 2371, the corrosion resistance being expressed as a reduction in thickness measured using a point micrometer after removal of rust.

These figures prove that corrosion resistance is substantially improved with phosphorus contents of more than 0.5% by weight and the process of the invention is greatly effectively.

TABLE 5

| Example | Lower layer Type** | Lower layer Build-up ($g/m^2$) | Upper layer Composition (wt %) | Upper layer Build-up ($g/m^2$) | Phosphate treatment | Wet adhesion | Crater prevention | Corrosion resistance without coating (hr) |
|---|---|---|---|---|---|---|---|---|
| E1 | E. Zn | 20 | Fe 97, P 3 | 3 | BT 3128 | 0/100 | ◎ | 288 |
| E2 | E. Zn | 20 | Fe 99.4, P 0.6 | 5 | BT 3128 | 0/100 | ◎ | 240 |
| E3 | Galvanealed Zn | 45 | Fe 98, P 2 | 3 | BT 3128 | 0/100 | ◎ | 360 |
| E4 | Galvanized Zn | 120 | Fe 90, P 10 | 8 | BT 3128 | 0/100 | ◎ | 480 |
| E5 | Zn—Ni (Ni 12%) | 20 | Fe 99.3, P 0.7 | 3 | BT 3128 | 0/100 | ◎ | 456 |
| E6 | Zn—Ni (Ni 12%) | 20 | Fe 97, P 3 | 5 | BT 3128 | 0/100 | ◎ | 480 |
| E7 | Zn—Ni (Ni 12%) | 20 | Fe 92, P 8 | 0.5 | BT 3128 | 0/100 | ◎ | 432 |
| E8* | SPCC | — | — | — | BT 3128 | 0/100 | ⊙ | 4 |
| E9* | E. Zn | 20 | — | — | BT 3128 | 100/100 | Δ | 24 |
| E10* | Galvanealed Zn | 45 | Fe 100 | 2 | BT 3128 | 50/100 | ◎ | 48 |
| E11* | Zn—Ni (Ni 12%) | 20 | Fe 99, P 1 | 0.005 | BT 3128 | 80/100 | X | 120 |
| E12* | Zn—Fe (Fe 15%) | 20 | — | — | BT 3128 | 50/100 | X | 24 |
| E13* | E. Zn | 20 | Fe 98.0, P 2.0 | 5 | nontreated | — | — | 36 |
| E14* | E. Zn—Ni (Ni 12%) | 20 | Fe 97, P 3, Zn 0.5 | 5 | nontreated | — | — | 144 |
| E15* | E. Zn—Fe (Fe 15%) | 20 | Fe 99.2, P 0.8 | 2 | nontreated | — | — | 48 |
| E16* | E. Zn | 20 | — | — | nontreated | — | — | 24 |
| E17* | Zn—Fe (Fe 15%) | 20 | — | — | nontreated | — | — | 24 |
| E18* | Zn—Ni (Ni 12%) | 20 | — | — | nontreated | — | — | 120 |
| E19* | Zn—Ni (Ni 12%) | 20 | — | — | SD 2000 | 50/100 | X | 144 |
| E20 | Zn—Fe (Fe 15%) | 20 | Fe 99.2, P 0.8 | 2 | SD 2000 | 0/100 | ◎ | 480 |
| E21 | Zn—Fe (Fe 15%) | 20 | Fe 98.9, P 1.1 | 3 | SD 2000 | 0/100 | ◎ | 456 |
| E22 | SPCC | — | Fe 94, P 6 | 5 | SD 2000 | 0/100 | ◎ | 26 |

*comparative examples
**E. = electroplated

What we claim is:

1. An Fe-P/Zn or Zn alloy double layer plated steel strip adapted for phosphate treatment, comprising
   a steel strip,
   a lower layer of zinc or a zinc alloy deposited on at least one surface of the steel strip, and
   an upper layer consisting essentially of 0.0003 to 15% by weight of phosphorus, balance essentially iron, electrodeposited at a current density of from more than 20 to 200 $A/dm^2$ on said lower layer to a build-up of at least 0.5 $g/m^2$, said Fe-P layer ensuring the formation of fine crystals of phosphophyllite having an average size of up to about 5 μm after a subsequent phosphate treatment.

2. An Fe-P plated steel strip according to claim 1, wherein the Fe-P layer has a phosphorus content of 0.0003 to 5% by weight.

3. An Fe-P/Zn or Zn alloy double layer plated steel strip according to claim 1 wherein the Fe-P layer is deposited to a build-up of 0.5 to 8 $g/m^2$.

4. An Fe-P/Zn or Zn alloy double layer plated steel strip according to claim 1 wherein the Fe-P layer is deposited to a build-up of 0.5 to 3 $g/m^2$.

5. An Fe-P/Zn or Zn alloy double layer plated steel strip adapted for phosphate treatment, comprising
   a steel strip,
   a lower layer of zinc or zinc alloy deposited on at least one surface of the steel strip,
   a layer consisting essentially of 0.0003 to 15% by weight of phosphorus, balance essentially iron electrodeposited on said lower layer at a current density of from more than 20 to 200 $A/dm^2$ to a build-up of at least 0.5 $g/m^2$, said Fe-P layer ensuring the formation of fine crystals of phosphophyllite having an average size of up to about 5 μm after a subsequent phosphate treatment, and
   a topcoat of one element selected from the group consisting of Ni, Zn, Mn and Ti, deposited on said Fe-P layer to a build-up of 5 to 50 $mg/m^2$.

6. An Fe-P/Zn or Zn alloy double layer plated steel strip according to claim 5 wherein the Fe-P layer is deposited to a build-up of 0.5 to 8 $g/m^2$.

7. An Fe-P/Zn or Zn alloy double layer plated steel strip according to claim 5 wherein the Fe-P layer is deposited to a build-up of 0.5 to 3 $g/m^2$.

8. A phosphate treated steel strip having improved corrosion resistance without paint coating, comprising
   a steel strip,
   a layer of zinc or a zinc alloy deposited on at least one surface of the steel strip,
   an uppermost layer consisting essentially of 0.0003 to 15% by weight of phosphorus, balance essentially iron, electrodeposited on said zinc or zinc alloy layer to a build-up of at least 0.5 $g/m^2$, and
   a surface film formed by chemically treating the Fe-P plating layer with a phosphate and consisting essentially of fine crystals of phosphophyllite having an average size of up to about 5 μm.

9. A process for making an Fe-P/Zn or Zn alloy double layer plated steel strip, comprising
   depositing zinc or a zinc alloy on at least one surface of a steel strip, and
   electroplating on the zinc or zinc alloy layer an alloy consisting essentially of 0.0003 to 15% by weight of phosphorus, balance essentially iron, in a plating bath essentially containing $Fe^{2+}$ ions in an amount of from 0.3 mol/liter to the solubility limit and hypophosphorus acid and/or a hypophosphite in an amount of 0.001 to 25 g/liter expressed as $NaH_2PO_2.H_2O$ at a pH of 1.0 to 5.0, a temperature of 30° to 60° C., and a current density of from more than 20 to 200 $A/dm^2$.

10. A process according to claim 9, wherein said current density is 40–150 $A/dm^2$.

11. A process according to claim 9, wherein the plating bath contains hypophosphorous acid and/or a hypophosphite in an amount of 0.001 to 8 g/liter expressed as $NaH_2PO_2.H_2O$ thereby electroplating an Fe-P layer containing 0.0003 to 5% by weight of phosphorus.

* * * * *